United States Patent [19]

Shields

[11] Patent Number: 4,495,505

[45] Date of Patent: Jan. 22, 1985

[54] PRINTED CIRCUIT BALUN WITH A DIPOLE ANTENNA

[75] Inventor: Michael W. Shields, Boulder, Colo.

[73] Assignee: The United States of America as represented by the Secretary of the Air Force, Washington, D.C.

[21] Appl. No.: 493,387

[22] Filed: May 10, 1983

[51] Int. Cl.[3] ..... H01Q 9/16; H01P 5/10

[52] U.S. Cl. ..... 343/821; 333/26

[58] Field of Search ..... 333/26, 21 R, 246; 343/821, 820, 822, 700 MS

[56] References Cited

U.S. PATENT DOCUMENTS

| | | | |
|---|---|---|---|
| 2,530,048 | 11/1950 | Driscoll | 333/26 X |
| 2,646,505 | 7/1953 | Alford | 333/26 X |
| 3,103,638 | 9/1963 | Greuet | 333/127 |
| 3,217,274 | 11/1965 | Alford | 333/26 |
| 3,571,722 | 3/1971 | Vendelin | 325/327 |
| 3,678,418 | 7/1972 | Woodward | 333/26 |
| 3,771,070 | 11/1973 | Gaudio | 333/26 |
| 3,784,933 | 1/1974 | Scherer et al. | 333/26 |
| 3,835,421 | 9/1974 | De Brecht et al. | 333/26 |
| 3,846,721 | 11/1974 | Fritz et al. | 333/26 |
| 3,976,959 | 8/1976 | Gaspari | 333/26 |
| 4,152,680 | 5/1979 | Harrison | 333/246 |
| 4,193,048 | 3/1980 | Nyhus | 333/26 |
| 4,240,052 | 12/1980 | Hallford et al. | 333/202 |
| 4,260,963 | 4/1981 | Drapac | 333/26 |
| 4,355,421 | 10/1982 | Seely | 455/327 |

FOREIGN PATENT DOCUMENTS

| | | | |
|---|---|---|---|
| 772605 | 4/1957 | United Kingdom | 343/822 |

OTHER PUBLICATIONS

Jasik, Henry, *Antenna Engineering Handbook*, 1981, Chapter 31, pp. 23–25.

*Primary Examiner*—Eugene R. LaRoche
*Assistant Examiner*—Benny Lee
*Attorney, Agent, or Firm*—Donald J. Singer; Richard J. Donahue

[57] ABSTRACT

A coplanar printed circuit balun for connecting an unbalanced feedline to a balanced dipole antenna.

6 Claims, 1 Drawing Figure

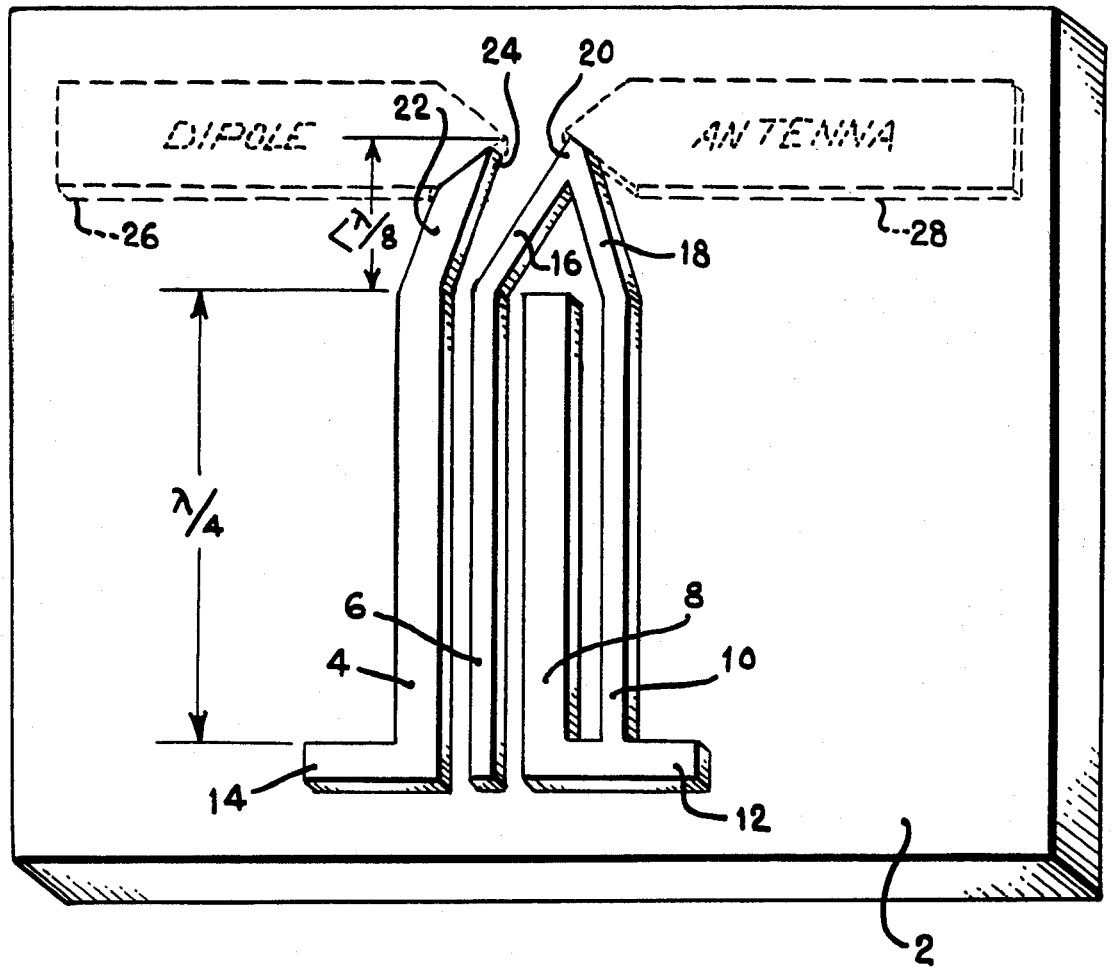
24
20
22
DIPOLE
ANTENNA
26
28
<λ/8
16
18
λ/4
6
8
4
10
14
12
2

PRINTED CIRCUIT BALUN WITH A DIPOLE ANTENNA

STATEMENT OF GOVERNMENT INTEREST

The invention described herein may be manufactured and used by or for the Government for governmental purposes without the payment of any royalty thereon.

BACKGROUND OF THE INVENTION

This invention relates in general to apparatus for converting a signal from one form to another and more particularly concerns a novel printed circuit balun.

It is often necessary to provide an interface signal matching device between a feedline and a printed circuit dipole antenna. This is generally accomplished by means of a balun, i.e., an unbalanced to balanced signal transformation device inserted in the feed structure. Such devices, when separately constructed of discrete components, add to the cost of the printed circuit antenna devices and increase their overall complexity. These drawbacks, however, can be eliminated if the balun can be formed on as a printed circuit together with the dipole antenna.

In U.S. Pat. No. 3,835,421 issued on Sept. 10, 1974 to DeBrecht et al, there is disclosed a printed circuit balun having some similarities in construction to the present invention. The DeBrecht et al device, however, which is discussed in some detail below, requires a length of conventional wire be soldered between two of its printed circuit conductors and has an inherent 4:1 impedance transformation ratio, as opposed to the inherent 1:1 impedance transformation ratio of the present invention.

SUMMARY OF THE INVENTION

It is therefore a principal object of the present invention to provide a new and improved printed circuit balun.

It is a further object of the present invention to provide a coplanar printed circuit balun having inherently equal input and output impedance values.

It is yet another object of the present invention to provide a printed circuit balun that does not require the use of electrical wiring above the surface of the printed circuit conductors.

These together with other objects, features and advantages of the invention will become more readily apparent from the following detailed description when taken in conjunction with the accompanying drawing.

DESCRIPTION OF THE DRAWING

The sole FIGURE of the drawing is a perspective view of the preferred embodiment of the present invention.

DETAILED DESCRIPTION OF THE PREFERRED EMBODIMENT

Referring now to the drawing, the invention will be seen to consist of a substrate material 2 having printed circuitry on one side thereof. Conductive strips 4, 6, and 8 form a three-wire transmission line whose center conductive strip 6 is adapted to accept the driven line of an unbalanced circuit, the center conductor of a coaxial line, the center line of a microstrip line or the center feedline of a stripline. The two outer conductive strips 4 and 8 connect to the common or grounded part of the unbalanced circuit, the shield of a coaxial cable or the ground planes of either the microstrip or stripline. An additional conductive strip 10 is disposed adjacent conductive strip 8 and is electrically connected to the bottom end thereof by means of a conductive member 12. A conductive member 14 is also connected to the bottom end of conductive strip 4 to provide a symmetrical unbalanced input configuration.

The top ends of conductive strips 6 and 10 are shorted together by conductive members 16 and 18 which form one of a pair of balanced output lines at their juncture 20. The top end of conductive strip 4 is extended by conductive member 22 to a point 24 which forms the other one of the balanced output lines. The balanced output lines 20 and 24 may be connected to any balanced load and are shown in the drawing to be connected to the arms 26 and 28 of a dipole antenna.

The length of the conductive strips 4, 6, 8 and 10 is one quarter wavelength of the center frequency of operation of the balun. The center conductor 6 of the three-wire transmission line may be adjusted in width, if necessary, to provide impedance matching between the impedance of the balanced load and the impedance of the unbalanced source. The substrate material may be any commonly used dielectric and in a preferred embodiment of the invention is made of fiberglass material impregnated with epoxy resin. The length of the conductive members 16, 18 and 22 is chosen to be less than one eighth wavelength of the center frequency of operation of the balun.

As previously mentioned there are similarities in construction between the present invention and a balun patented by DeBrecht et al in U.S. Pat. No. 3,835,421. The balun shown by DeBrecht et al in FIG. 6 of the patent uses an unbalanced, coplanar line, as does the present invention, to connect to a balanced load. The printed circuit short is at the balanced load end of that balun and it contains one less, a total of three, printed circuit lines. The DeBrecht et al balun also has a small external (not printed) wire connecting the two outside printed lines insuring they remain at equal direct current and radio frequency potential. The operation of that device, as described by DeBrecht et al, utilizes the simultaneous excitation of even and odd transmission line modes with their respective impedances to produce currents at the output which are balanced or of equal magnitude but opposite phase. The result is an almost monolithic (the shorting wire is required) balun printed on a single side of a material which is only a quarter wavelength (dielectric corrected) long.

One feature of this device, as stated by DeBrecht et al, is its impedance transformation properties. At center frequency, the balanced load impedance is transformed to:

$$Z_{in}=(2\ Z_{oe})^2/Z_L$$

wherein $Z_{in}$ is the desired, or signal source characteristic impedance, $Z_L$ is the balanced load impedance and $Z_{oe}$ is the balanced mode characteristic impedance of the coplanar stripline. This balanced mode characteristic impedance as referred to by DeBrecht et al is simply the characteristic impedance of the coplanar (three wire) stripline operating in its normal transmission mode with the outer two conductors at equal or ground R.F. potential and the center conductor at the opposite potential. Excluding the degradation of performance over bandwidth, the balun represents a 4:1 impedance transformation balun and is a coplanar stripline realization of a coaxial "split tube" balun as shown by Jasik in Chapter 31 of the, Antenna Engineering Handbook, a McGraw Hill publication.

The balun disclosed herein is a coplanar stripline version of the "two tube" balun also described in Jasik, in the aforementioned publication. The present device utilizes the balanced and unbalanced modes described by DeBrecht et al in the following way. The unbalanced mode exists between the outer conductive strips 4 and 8 and the center conductive strip 6 as shown in the drawing. Upon leaving the unbalanced transmission line region, the energy is reflected in an unbalanced mode between conductors 8 and 10. This energy experiences a short at member 12, one quarter wavelength from its point of generation and cannot propagate. The odd mode impedance, the open circuit formed by conductors 8 and 10 exists in parallel with the load and hence does not change its value. The resulting impedance seen at the unbalanced terminals 6, 12, and 14 is:

$$Z_{in}=(Z_{oe})^2/Z_L$$

where $Z_{oe}$ is the even mode characteristic impedance of the line and $Z_L$ is the balanced load impedance across lines 20 and 22. This even mode impedance is the characteristic impedance of the coplanar stripline, lines 4, 6 and 8.

The present device, then, has a capability of transforming impedance levels between the balanced load placed at the transmission lines 20 and 24 and the unbalanced line at 14, 6 and 12 by a normal quarter wavelength matching transformer. This differs from the DeBrecht et al balun because it has an inherent 1:1 transformation ratio versus the inherent 4:1 present in that device. A physical disadvantage of the DeBrecht et al device is the small shorting wire required to maintain equal potential of the outer conductors. An additional operation is needed to install this wire over the simple monolithic (single side) printed circuit etching of the whole device.

While the invention has been described in terms of its preferred embodiment it is understood that the words which have been used are words of description rather than words of limitation and the changes within the purview of the appended claims may be made without departing from the scope and spirit of the invention in its broader aspects.

What is claimed is:

1. An improved printed circuit balun comprising:

a dielectric substrate, first, second, third and fourth spaced conductive strips each having a first and second end and disposed in parallel in an uninterrupted numerical order upon a surface of said substrate, a first conductive member connected to the first end of said first conductive strip, a second conductive member connected to the first end of said third and fourth conductive strips, said first end of said second conductive strip and said first and second conductive members providing a means for connecting an unbalanced transmission line to said balun, a pair of balanced output lines, a third conductive member connected between the second end of said first conductive strip and one of said pair of balanced output lines, a fourth conductive member connected between the second end of second conductive strip and the other one of said pair of balanced output lines, and a fifth conductive member connected between the second end of said fourth conductive strip and the other of said pair of balanced output lines.

2. Apparatus as defined in claim 1 wherein the lengths of said conductive strips are one quarter wavelength of the center frequency applied to said balun.

3. Apparatus as defined in claim 2 wherein the length of said third, fourth and fifth conductive members do not extend more than one eighth wavelength of the center frequency of said balun beyond the end of said conductive strips.

4. Apparatus as defined in claim 3 wherein the width of said second conductive strip differs from that of said first and third conductive strips.

5. Apparatus as defined in claim 4 and further including a printed circuit dipole antenna connected to said pair of output lines.

6. Apparatus of claim 5 wherein said dielectric substrate is formed of epoxy impregnated fiberglass material.

* * * * *